US005519405A

United States Patent [19]

Matsubara et al.

[11] Patent Number: 5,519,405

[45] Date of Patent: May 21, 1996

[54] DIRECTION ADJUSTMENT INDICATOR FOR A SATELLITE RADIO WAVE RECEIVING ANTENNA

[75] Inventors: Hiroshi Matsubara; Sohei Maruyama, both of Aichi, Japan

[73] Assignee: Masprodenkoh Kabushiki kaisha, Japan

[21] Appl. No.: 227,768

[22] Filed: Apr. 14, 1994

[30] Foreign Application Priority Data

Apr. 16, 1993 [JP] Japan ..... 5-114146
Aug. 26, 1993 [JP] Japan ..... 5-234056

[51] Int. Cl.[6] ..... H01Q 3/00

[52] U.S. Cl. ..... 342/359; 342/75; 342/426; 343/757

[58] Field of Search ..... 342/75, 76, 359, 342/422, 426; 343/757

[56] References Cited

U.S. PATENT DOCUMENTS 3,671,969 6/1972 Basman ..... 343/11.17 R
4,054,871 10/1977 Terrell et al. ..... 343/7.7
4,187,501 2/1980 Obsch et al. ..... 340/554
4,282,524 8/1981 Eymann et al. ..... 343/14
4,853,839 8/1989 Nichols et al. ..... 364/167.01
5,296,862 3/1994 Rodeffer et al. ..... 342/359

FOREIGN PATENT DOCUMENTS 59-47883 11/1984 Japan .
224244 7/1990 Japan .

*Primary Examiner*—Thomas H. Tarcza
*Assistant Examiner*—Dao L. Phan
*Attorney, Agent, or Firm*—William A. Drucker

[57] ABSTRACT

A direction adjustment indicator for a satellite radio wave receiving antenna comprises a demodulating circuit to demodulate a satellite radio wave received by the antenna, a peak holding circuit always to output a held peak value of the demodulated output of the demodulating circuit, a comparator circuit and a display element. The comparator circuit compares the instantaneous value of the demodulated output and the held peak value, and outputs a signal when both values are equal and another different signal when both values are not equal. The display element gives two different kinds of display in accordance with the signals. While the azimuth angle of the antenna is varied in one direction, a peak value of the demodulated output is held and while the angle is varied in the opposite direction, the optimum azimuth angle is displayed for which the instantaneous value of the demodulated output agrees with the held peak value.

1 Claim, 5 Drawing Sheets

DIRECTION ADJUSTMENT INDICATOR FOR A SATELLITE RADIO WAVE RECEIVING ANTENNA

BACKGROUND OF THE INVENTION

1. Field of the Invention

This invention relates to an indicator to teach the desirable receiving direction of a satellite radio wave receiving antenna while the direction of the antenna is adjusted.

2. Description of the Prior Art

When a satellite radio wave received by an antenna is demodulated and the demodulated output of the wave exceeds a predetermined reference level, an indicator lights, and when the demodulated output does not exceed the level, the indicator is extinguished. Let it be supposed that this reference level is set to a value appropriate for an area where the received level of the satellite radio wave is high, for example, for Nagoyo (the central area of Japan). When the antenna is directed in a desirable receiving direction, that is, in the direction of high received radio wave level, the indicator lights and it is otherwise extinguished. The antenna is thus mounted successfully so that it may be directed in the desirable direction.

When the indicator with the same reference level is used in an area where the received radio wave level is low, for example, in Okinawa (the south end area of Japan), the demodulated output in any receiving direction, however, does not exceed the reference level and the indicator continues to be extinguished. The indicator, therefor, is not helpful for finding the desirable receiving direction. If the reference level is lowered and the indicator operates satisfactorily in the area of low received radio wave level, this indicator, in turn, continues to light in the area of high received radio wave level and again is not helpful for finding the desirable receiving direction.

The received level of the satellite radio wave, moreover, decreases with increasing cloudiness. The reference level of the indicator is usually set to a value appropriate for the clear sky in an area. When this indicator is used under the cloudy sky even in the same area, the indicator does not light for any receiving direction and may not be helpful for determining the desirable receiving direction.

SUMMARY OF THE INVENTION

A first object of the present invention is to provide that direction adjustment indicator for a satellite radio wave receiving antenna which can teach the desirable receiving direction of the antenna in an area either of high or low received level of the satellite radio wave.

This indicator of the invention includes a demodulating circuit to demodulate a satellite radio wave received by the antenna, a peak holding circuit always to output the held peak value of the demodulated output, a comparator circuit to compare the instantaneous value of the demodulated output and the held peak value, to give a signal when both values are equal and to give another different signal when both values are not equal and a display element to give two different kinds of display corresponding to the signals of the comparator circuit. While the azimuth angle of the antenna is varied in one direction, the peak value is held and while the angle is varied in the opposite direction, the optimum azimuth angle is indicated for which the instantaneous value of the demodulated output agrees with the held peak value.

A second object of the invention is to provide that direction adjustment indicator for a satellite radio wave receiving antenna which has the construction and function described in the first object and operates normally only when the antenna is directed in the direction appropriate for obtaining a CN ratio to make received pictures excellent.

This indicator of the invention includes a generator of a reference value coincident with the demodulated output of the satellite radio wave with a predetermined CN ratio and a selector to select, as its output, the larger one out of the reference value and the held peak value of the demodulated output. The output of this selector and the demodulated output are compared in the comparator circuit and the indicator gives displays in accordance with the result of comparison.

A third object of the invention is to provide that direction adjustment indicator for a satellite radio wave receiving antenna which can teach correctly the desirable receiving direction of the antenna even though cloudiness changes suddenly in a work to adjust the receiving direction of the antenna.

This indicator of the invention includes a demodulating circuit to demodulate a satellite radio wave received by the antenna, a peak holding circuit always to output the held peak value of the demodulated output, a comparator circuit to compare the instantaneous value of the demodulated output and the held peak value, to give a signal when both values are equal and to give another different signal when both values are not equal and a display element to give two different kinds of display corresponding to the signals of the comparator circuit, and the peak holding circuit is provided with a reset means. When a peak value is held and the instantaneous value of the demodulated output does not reach this held value thereafter in a predetermined time interval, the reset means resets the held peak value. After the old held peak value is reset, a new peak value corresponding to a new value of cloudiness is again held and the indicator teaches the desirable receiving direction.

A fourth object of the invention is to provide that direction adjustment indicator for a satellite radio wave receiving antenna which has the construction and function described in the first object and furthermore a reset means to renew the held peak value at every predetermined time interval.

A fifth object of the invention is to provide that direction adjustment indicator for a satellite radio wave receiving antenna which has the construction and function described in the first object and furthermore a reset means able to reset automatically the held peak value when the appropriate receiving direction can not be obtained despite of a adjusting work continuing for a predetermined time interval.

Other objects and advantages of the invention will become apparent during the following discussion of the accompanying drawings.

DESCRIPTION OF THE PREFERRED EMBODIMENTS

Figure 1:
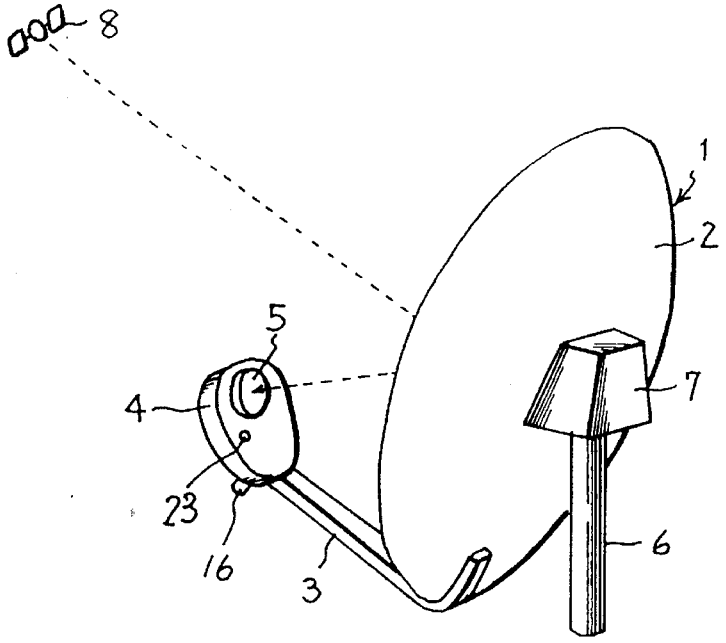
FIG. 1 is a perspective view of a satellite radio wave receiving antenna.

Embodiments of the present invention are explained in reference with drawings. An offset parabola antenna 1 is mounted as a satellite radio wave receiving antenna. The antenna 1 comprises a reflector 2, an arm 3, a converter 4 with a built-in primary radiator and a cover 5 for the radiator. The antenna 1 is mounted on a mast 6 with an adjustable support 7, which is adapted to adjust the angle of elevation and the azimuth angle of the antenna 1 in a well known manner. A stationary satellite 8 (a broadcasting or communication satellite) is radiating satellite radio wave in the sky.

Figure 2:
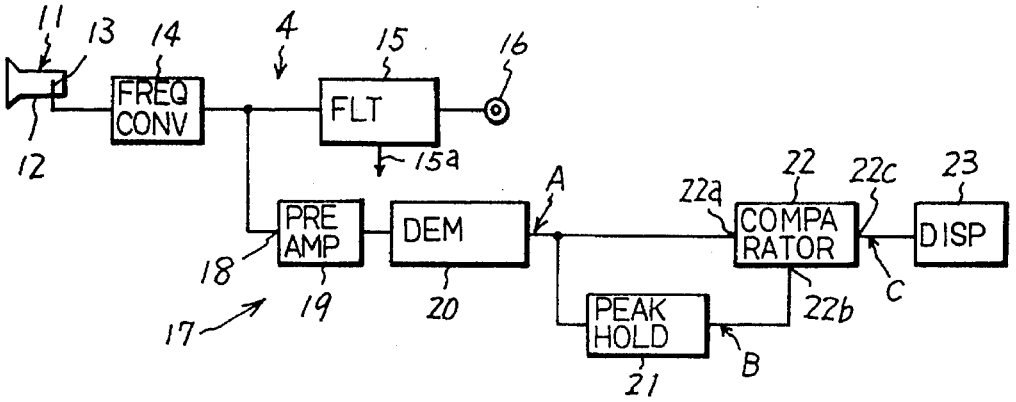
FIG. 2 is a block diagram of a converter for the antenna in FIG. 1.

The converter 4 as shown in FIG. 2 comprises a primary radiator 11 consisting of a wave guide 12 and a probe 13, a frequency converting circuit 14, a power source separating filter 15 and an output terminal 16. The members 11 through 16 are well known in the converter of this kind. A direction adjustment indicator 17 is built in the converter 4. The indicator 17 comprises a-pre-amplifier 19 to amplify the demodulated output of the satellite radio wave, an input end 18 both for the indicator 17 and the pre-amplifier 19, a demodulating circuit 20, a peak holding circuit 21, a comparator circuit 22 and a display element 23. The comparator circuit 22 is constructed in such a manner that an output terminal **22*c* may output a signal, for example, a signal "L" when two input levels given at input terminals 22*a* and 22*b* are equal and another-different signal, for example, a signal "H" when the two input levels given are not equal. The display element 23 in this embodiment is a light emitting diode exposed at a visible point on the outside surface of the converter 4** and is adapted to light or be extinguished in accordance with the signal "L" or "H". A buzzer to give indication by sounding or silence or an analogue meter to give indication by swinging or rest of an index may be used as the display element.

The converter 4 operates as follows. When a direct current is supplied to the output terminal 16 from an external power source, this current flows out of the power source separating filter 15 in the direction of an arrow **15*a* and is supplied, through a power supplying circuit not shown, to the frequency converting circuit 14 to energize this circuit. This current is supplied to the other members of the indicator 17** to energize them.

When the radio wave from the satellite 8 is reflected by the reflector 2 and comes to the primary radiator 11, the radio wave is picked up by the probe 13 and is transformed into an intermediate frequency signal in the frequency converting circuit 14. The output of the circuit 14 is sent out, through the filter 15, from the output terminal 16.

The intermediate frequency signal is amplified by the pre-amplifier 19 in the indicator 17, is demodulated by the demodulating circuit 20 and becomes a direct current signal. The peak holding circuit 21 receives this signal and always outputs a direct current signal (held peak signal) corresponding to the peak value of that direct current signal of the circuit 20 which has been held. The comparator circuit 22 receives the direct current signal of the circuit 20 and the held peak signal, compares them and gives two different outputs. The display element 23 lights or is extinguished in accordance with either one of these outputs.

Figure 3A:
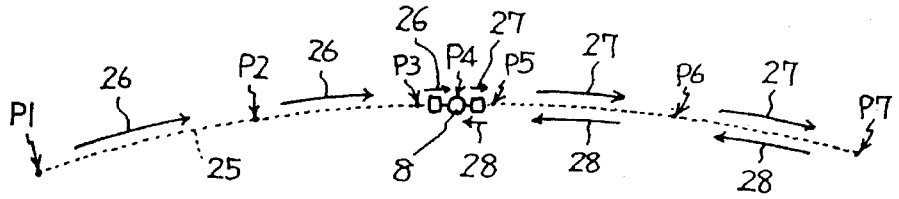
FIGS. 3A through 3D are views for explaining various processes to adjust the receiving direction of the antenna.

The receiving direction of the antenna 1 is adjusted with the indicator 17 in the following manner. The angle of elevation of the antenna 1 is beforehand set, by adjusting the support 7, to a known value appropriate for the area where the antenna 1 is mounted. The azimuth angle of the antenna 1 is adjusted with this constant angle of elevation. When the azimuth angle of the antenna 1 increases continuously in one direction, the directing point of the antenna 1 in the sky moves from P1 to P7 along a path 25 in the direction of an arrow 26 in FIG. 3A. When the sky is clear, the relationship between the directing point (azimuth angle) and the received level of the antenna 1 is represented by a curve B1 in FIG. 3B. A curve such as B1 is referred to hereinafter as a DL (Directing point-Level) curve. While the directing point is moving from P1 to P4, the received level increases monotonically with the increasing azimuth angle. Since the output of the demodulating circuit 20, therefore, is always held by the peak holding circuit 21, the inputs to the inputs terminals **22*a* and 22*b* always agree with each other and the display element 23 continues to be extinguished. A stuffed circle drawn close to the curve B1 means the extinction of the display element 23. While the directing point is moving from P4 to P7 in the direction of an arrow 27 and the azimuth angle is further increasing, the received level decreases monotonically and the output of the circuit 20 is always smaller the the held peak value at the directing point P4. The display element 23 thus continues to light. An open circle drawn close to the curve B1 means the lighting of the display element 23. While the directing point is then moving from P7 towards P1 in the opposite direction and the azimuth angle is decreasing in the opposite direction, the received level first increases monotonically. When the directing point again reaches the point P4, the two inputs of the comparator circuit 22 agree with each other, the circuit 22 outputs the signal "L" and the display element 23 is again extinguished. A worker adjusting the receiving direction of the antenna 1 knows, by this second extinction, that the directing point P4 is in the desirable receiving direction of the antenna 1. Tab. 1 lists the directing point, the voltage levels "mV" at points A and B in FIG. 2, the output signal at a point C and the state of the display element 23. A table such as Tab. 1 is referred to hereinafter as an LSD (Level-Signal- Display) table. Even if the directing point then moves repeatedly from P1 to P7, the display element 23 is extinguished only when the directing point reaches P4. If this extinction of the display element 23** is confirmed over and over, the desirable receiving direction can be determined with high reliability.

TABLE 1

| directing point | P1 | P2 | P3 | P4 | P5 | P6 | P7 | P6 | P5 | P4 |
|---|---|---|---|---|---|---|---|---|---|---|
| point A | 10 | 0 | 30 | 40 | 30 | 10 | 0 | 10 | 30 | 40 |
| point B | 0 | 10 | 30 | 40 | 40 | 40 | 40 | 40 | 40 | 40 |
| point C | L | L | L | L | H | H | H | H | H | L |
| display element | ● | ● | ● | ● | ○ | ○ | ○ | ○ | ○ | ● |

Figure 3B:
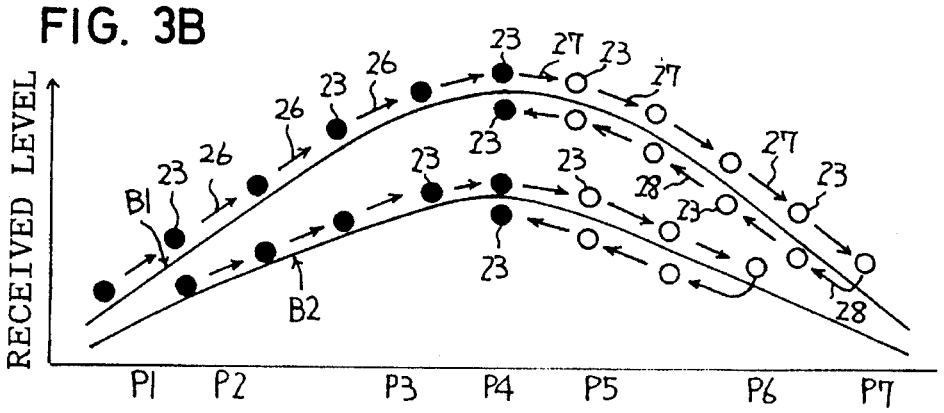

When the sky is clouded, the received level of the satellite radio wave is generally low. A DL curve for a clouded sky is, for example, a curve B2 in FIG. 3B. Tab. 2 is an LSD table for the clouded sky. FIG. 3B and Tab. 2 show that the antenna 1 can be directed in the desirable direction, on the basis of the display element 23, under the clouded sky as well as the clear sky.

TABLE 2

| directing point | P1 | P2 | P3 | P4 | P5 | P6 | P7 | P6 | P5 | P4 |
|---|---|---|---|---|---|---|---|---|---|---|
| point A | 0 | 0 | 20 | 30 | 20 | 0 | 0 | 0 | 20 | 30 |
| point B | 0 | 0 | 20 | 30 | 30 | 30 | 30 | 30 | 30 | 30 |
| point C | L | L | L | L | H | H | H | H | H | L |
| display element | ● | ● | ● | ● | ○ | ○ | ○ | ○ | ○ | ● |

When the azimuth angle of the antenna is adjusted in an area of low received level, a DL curve and an LSD table in this case are similar to the curve B2 in FIG. 3B and Tab. 2, respectively. The azimuth angle of the antenna 1 is adjusted to an appropriate value and the antenna can be directed in the desirable direction also in this case.

Either when the received level of the satellite radio wave is generally high in the movement range of the direction point or when the level is generally low, the display element 23 lights or is extinguished in the above mentioned manner. The antenna 1 is thus directed in the desirable direction, with the indicator 17, in the area of either high or low received level.

The direction adjustment indicator 17 may be constructed as a unit separated from the converter 4. This unit comprises the members 18 through 23 and a casing containing these members. The input end 18 of this unit is connected to the output or monitor terminal of the converter in the work to adjust the receiving direction of the antenna.

Figure 4:
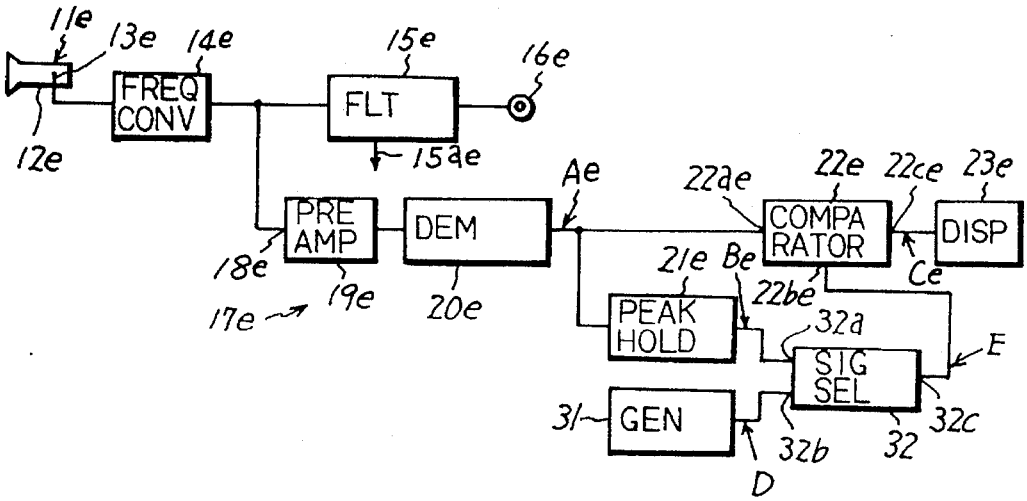
FIG. 4 is a view similar to FIG. 2, showing a different embodiment.

FIG. 4 shows a different embodiment of the present invention. Same reference numerals are given to those members in different embodiments which are considered to be same or equivalent, the different embodiments are distinguished by alphabets e, f, g, h and i if necessary, and the explanation of these members is not repeated. A display element **23*e* of this embodiment is adapted to operate normally as in the previous embodiment only when the antenna is directed in the direction where a CN ratio to make received pictures excellent (14 dB, for example, according to the standard of NHK (Japan Broadcasting Association)) is obtained. The display element 23*e* is adapted not to operate when the antenna is directed in the other directions. This display element 23*e* prevents the azimuth angle of the antenna from being adjusted unsatisfactorily in an appropriate adjustment range. A reference value generator 31 in FIG. 4 is adapted to generate a reference value, which agrees with the output level of a demodulating circuit 20*e* demodulating the radio wave with a predetermined CN ratio. This generator 31 is, for example, a DC voltage generator to generate a predetermined DC voltage. A signal selector 32 is adapted to output the higher level signal out of the signals reaching the input terminals 32*a* and 32*b***.

Figure 5:
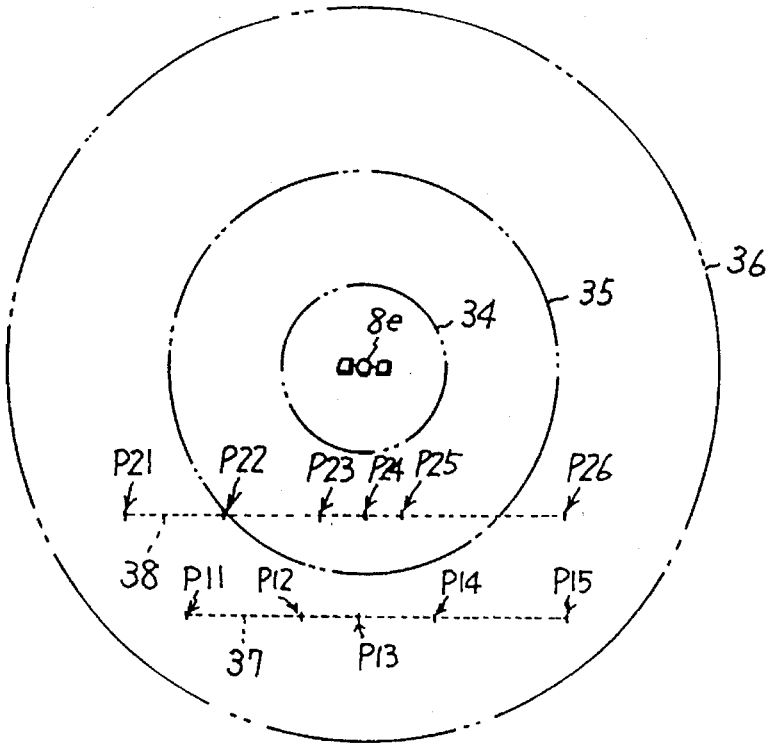
FIG. 5 is a view for explaining an example of the process to adjust the receiving direction of the antenna with the embodiment in FIG. 4.

The receiving direction of the antenna 1 is adjusted with the embodiment of FIG. 4 as follows. Circles 34, 35 and 36 in the sky in FIG. 5 represent the boundaries of the areas where the CN ratio is not less than 20 dB, 14 dB and 5 dB, respectively. When the angle of elevation of the antenna much deviates from its appropriate value, the directing point of the antenna in the sky moves, with the changing azimuth angle of the antenna, from P11 to P15 in FIG. 5 along a path 37. The reference value of the generator 31 in this case is always greater than the held peak value. This reference value is given from the signal selector 32 to an input terminal **22*be* of a comparator circuit 22*e*. The output of the comparator circuit 22*e* is always "H" and the display element 23*e*** continues to light. The worker, therefor, can know that the angle of elevation of the antenna is not appropriate. Tab. 3 is an LSD table in this case.

TABLE 3

| directing point | P11 | P12 | P13 | P14 | P15 |
|---|---|---|---|---|---|
| point Ae | 0 | 5 | 8 | 5 | 0 |
| point Be | 0 | 5 | 8 | 8 | 8 |
| point D | 9 | 9 | 9 | 9 | 9 |
| point E | 9 | 9 | 9 | 9 | 9 |
| point Ce | H | H | H | H | H |
| display element | ○ | ○ | ○ | ○ | ○ |

The worker then changes the angle of elevation to another value and moves the directing point, with the changing azimuth angle, from P21 to P26 in FIG. 5, for example, along a path 38. When the directing point is one of points P22 through 24, the output of the signal selector 32 is the held peak value of the demodulated output and the display element is extinguished. When the directing point moves to P25 or P26, the output of the demodulating circuit **20*e* decreases and the display element 23*e* lights. When the worker moves the directing point from P26 towards P21 in the opposite direction and the point again agrees with P24, the display element is again extinguished. The worker can direct the antenna, by this extinct, to the directing point P24 which gives the maximum CN ratio along the path 38. When the directing point agrees with the position of a satellite 8*e*, the maximum CN ratio in the sky is obtained. Although the directing point P24 does not agree with the position of the satellite, this point lies in the area inside the circle 35 and the CN ratio in this area exceeds the standard value 14 dB. Excellent received pictures are thus obtained at the directing point P24**. Tab. 4 is an LSD table in this case.

TABLE 4

| directing point | P21 | P22 | P23 | P24 | P25 | P26 | P25 | P24 |
|---|---|---|---|---|---|---|---|---|
| point Ae | 0 | 10 | 20 | 25 | 20 | 0 | 20 | 25 |
| point Be | 0 | 10 | 20 | 25 | 25 | 25 | 25 | 25 |
| point D | 9 | 9 | 9 | 9 | 9 | 9 | 9 | 9 |
| point E | 9 | 10 | 20 | 25 | 25 | 25 | 25 | 25 |
| point Ce | H | L | L | L | H | H | H | L |
| display element | ○ | ● | ● | ● | ○ | ○ | ○ | ● |

When the antenna 1 is obliquely mounted on the guardrail of a porch, the division for the angle of elevation of the support 7 is not helpful in adjusting the angle of elevation of the antenna 1. Although the angle of elevation in this case may much deviate from an appropriate value, the combination of the generator 31 and the selector 32 can teach the worker, in the above mentioned manner, that the angle of elevation is inappropriate. The worker tries the adjustment of the azimuth angle with a couple of new angles of elevation and can finally find the angle of elevation with which the display element **23*e*** operates normally. The azimuth angle of the antenna is adjusted, with this angle of elevation, to an optimum value and the antenna can be directed in the direction giving the CN ratio not less than the standard value.

Figure 6:
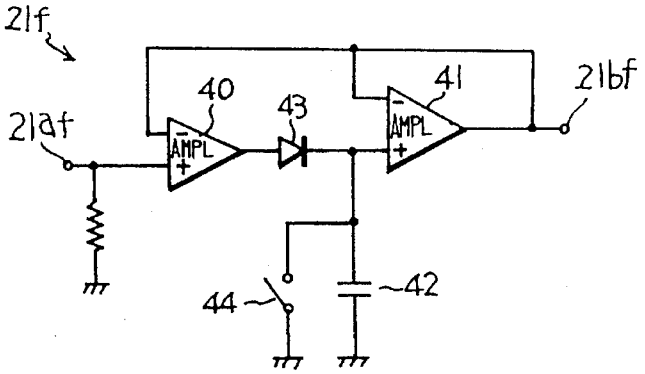
FIG. 6 is a circuit diagram of a peak holding circuit provided with a reset means.

FIG. 6 shows a different embodiment of the peak holding circuit 21 in FIG. 2. The peak holding circuit **21*f* comprises an input terminal 21*af*, an output terminal 21*bf*, operational amplifiers 40 and 41 as amplifiers, a peak holding capacitor 42, a diode 43 to prevent the discharge of the capacitor 42** and a switch 44 as a reset means. The switch 44 is adapted to discharge the capacitor 42 and thereby to eliminate the above mentioned held peak value.

The peak holding circuit 21*f* operates as follows. When the switch 44 is open and the input at the terminal 21*af* is not less than the voltage of the capacitor 42, the output voltage of the operational amplifier 40 charges, through the diode 43, the capacitor 42. The operational amplifier 41 receives the voltage of the capacitor 42 as its input voltage and the output voltage at the terminal 21*bf* is equal to the input voltage at the terminal 21*af*. When the voltage at the terminal 21*af* decreases to a value less than the voltage of the capacitor 42, the operational amplifier 40 stop charging the capacitor 42 and the discharge of the capacitor 42 is prevented by the diode 43. The capacitor 42 holds the peak value of the input voltage at the terminal 21*af* in this manner. The voltage at the terminal 21*bf* at this time is the held peak value. When the switch 44 is closed manually, for example, the capacitor 42 is discharged instantly and is again charged by the operational amplifier 40. The capacitor 42 then holds a new peak value of the input voltage at the terminal 21*af* in the same manner.

Figure 3C:
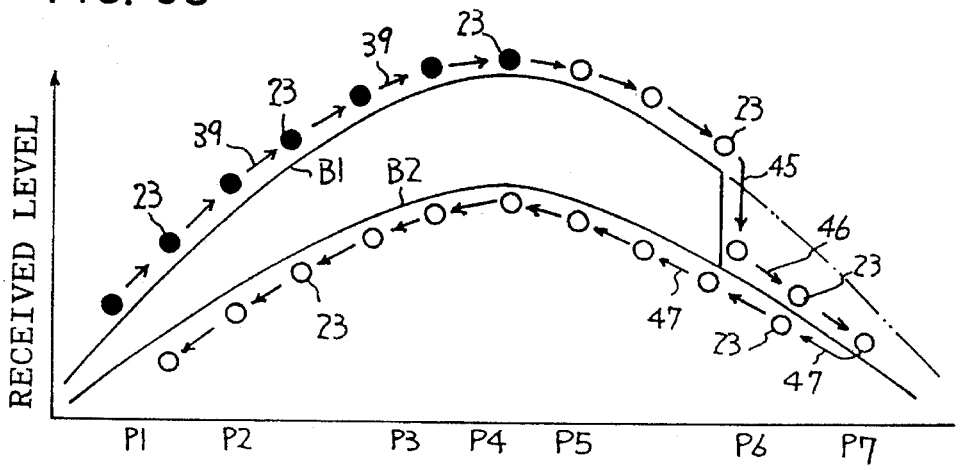
Figure 3D:
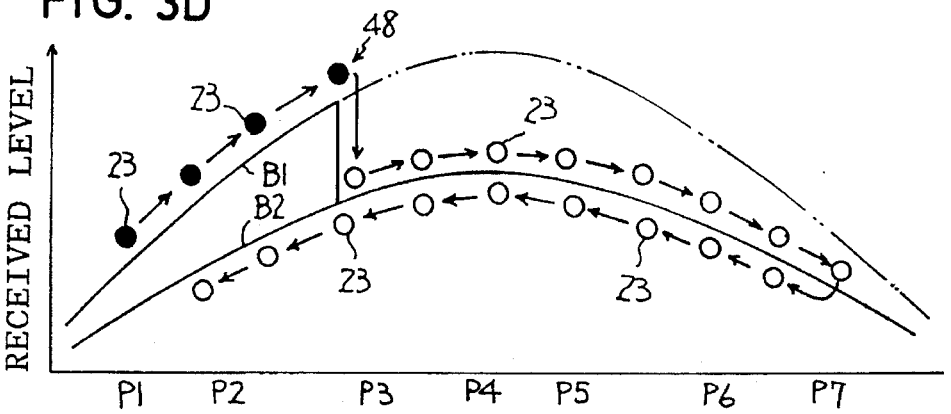

The azimuth angle of the antenna 1 is adjusted with the indicator 17 provided with the peak holding circuit in FIG. 6 as follows. Let it be supposed that the sky becomes suddenly clouded while the azimuth angle of the antenna 1 is adjusted. While the directing point is moving in one direction from P1 towards P5 in FIG. 3C under the clear sky, the received level of the antenna 1 varies along the curve B1 in FIG. 3C in the direction of an arrow 39. A peak value of the demodulated output (for example 40 mV) is held in this while. When the directing point has moved as far as P6, the cloudiness between the antenna and the satellite 8 increases suddenly. The received level decreases in the direction of an arrow 45 in FIG. 3C and then varies along the curve B2 for the clouded sky in the direction shown by arrows 46 and 47. Even though the directing point returns to P1 from P7, the demodulated output does not reach the held peak value and the display element 23 continues to light. Tab. 5 is an LSD table in this case.

TABLE 5

| directing point | P1 | P2 | P3 | P4 | P5 | P6 | P7 | P6 | P5 | P4 | P3 | P2 | P1 |
|---|---|---|---|---|---|---|---|---|---|---|---|---|---|
| point A | 0 | 10 | 30 | 40 | 30 | 0 | 0 | 0 | 20 | 30 | 20 | 0 | 0 |
| point B | 0 | 10 | 30 | 40 | 40 | 40 | 40 | 40 | 40 | 40 | 40 | 40 | 40 |
| point C | L | L | L | L | H | H | H | H | H | H | H | H | H |
| display element | ● | ● | ● | ● | ○ | ○ | ○ | ○ | ○ | ○ | ○ | ○ | ○ |

When the directing point has been returned to P1, the switch 44 for resetting is closed and held peak value is reset. The status shown by the left hand side column of P1 in Tab. 5 is reproduced in the indicator 17. When the azimuth angle of the antenna 1 is varied, the received level and the display of the element 23 change in accordance with the curve B2 in FIG. 3B and Tab. 2. The antenna 1, therefor, can be directed in the desirable direction. Let it be supposed that the sky becomes cloudy before the azimuth angle of the antenna 1 is adjusted to an appropriate value. FIG. 8D shows DL curves in this case. The peak value of the demodulated output in this case is held at a point shown by a numeral 48, the demodulated output thereafter does not reach the held peak value and the display element 28 continues to light. This peak value is reset in the same manner and the azimuth angle is again adjusted.

When the optimum value of the azimuth angle of the angle can not be found on account of the sudden change of the sky, the azimuth angle can be again adjusted in a simple manner by the help of the reset means 44.

Figure 7:
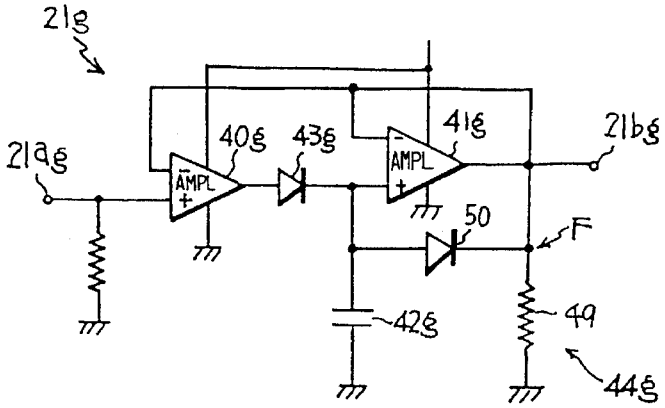
FIG. 7 is a circuit diagram of a peak holding circuit provided with a different reset means.

FIG. 7 shows a peak holding circuit provided with a different reset means. This peak holding circuit 21g includes a discharge resistor 49 and a blocking diode 50. When the capacity of a capacitor 42*g* is, for example, 3.3 μF, the resistance of the resistor 49 is 100 kΩ.

A reset means 44*g* in FIG. 7 operates as follows. When the converter 4 is energized by a power supply (a tuner or booster for receiving satellite radio wave, for example), the potential at a point F is equal to that of the capacitor 42*g*. The discharge of the capacitor 42*g* is prevented by the diode 50 and a peak value of the demodulated output is held. When the worker turns off the power switch of the source, the potential at the point F vanishes, the capacitor 42*g* is discharged through the resistor 49 and the diode 50 and the held peak value is reset.

Figure 8:
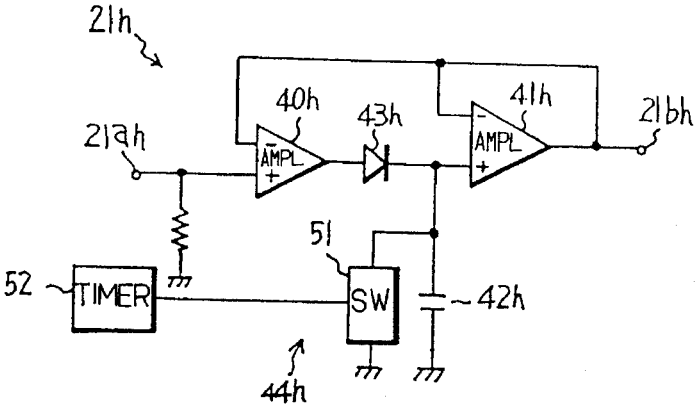
FIG. 8 is a circuit diagram of a peak holding circuit provided with a still different reset means.

FIG. 8 shows a peak holding circuit provided with a still different reset means. A switching circuit 51 for resetting is, for example, an electronic switch such as a switching transistor or a FET or a mechanical switch such as a relay. A timer circuit 52 is adapted to output a triggering pulse to turn on the switching circuit 51 at every predetermined time interval such as a time necessary for one round adjustment of the azimuth angle of the antenna (usually 3 minutes).

The reset means 44*h* in FIG. 8 operates as follows. When the power supply to the indicator 17 begins, the timer circuit 52 begins to count time. When the optimum value of the azimuth angle of the antenna 1 can not be found in the above mentioned predetermined time interval even if the angle is varied once back and forth, the pulse output by the timer circuit 52 turns on the switching circuit 51. The capacitor 42*h* is thereby discharged and the held peak value is reset.

Figure 9:
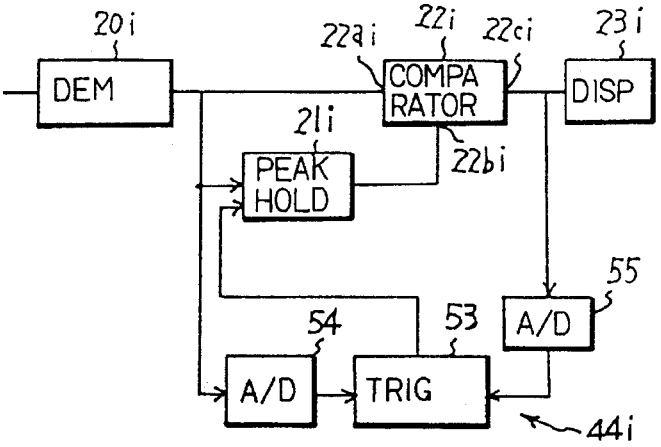
FIG. 9 is a circuit diagram of a peak holding circuit operating under different reset conditions.
Figure 10:
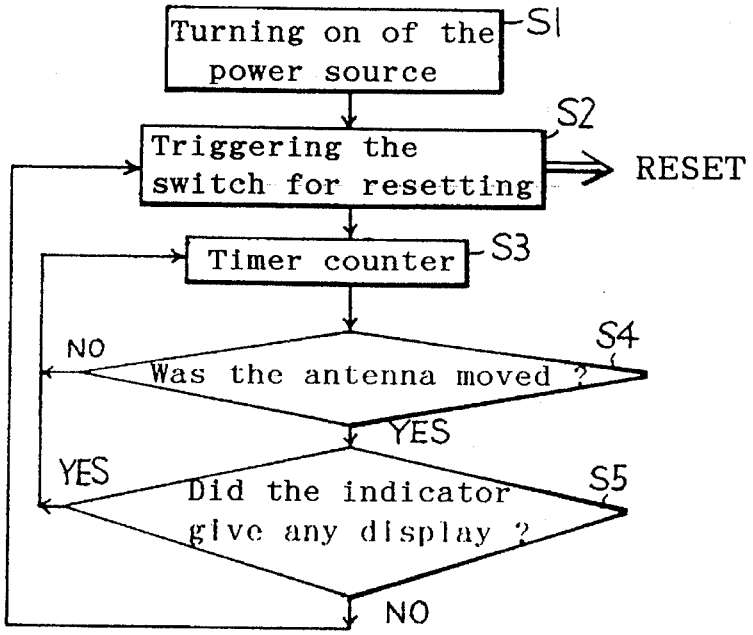
FIG. 10 is a flow chart showing the operation of the reset means in FIG. 9

FIGS. 9 and 10 show a peak holding circuit provided with a still different reset means. A triggering means 53 is adapted to give a triggering pulse to the switching circuit 51 in FIG. 8 and is, for example, a micro computer. An A/D converter 54 is adapted to find, through the variation in the demodulated output, whether the antenna is moved or not. Another A/D converter 55 is adapted to find the operation of a display element 231 through the output of a comparator circuit 22*i*.

The reset means in FIG. 9 operates as follows in accordance with a flow chart in FIG. 10. The turning on of the power source for the indicator 17 is detected in a step S1 and a peak holding circuit 21*i* is first reset in a step S2. After a predetermined time, for example, of 30 seconds is next counted in a step S3, it is judged in a step S4 whether the antenna is moved in the predetermined time. If the antenna is moved, it is further judged in a step S5 whether a display element 23*i* is extinguished in the predetermined time. If the display element 23*i* is not extinguished, the peak value already held is reset again in the step S2.

When the demodulated output decreases in the work to adjust the receiving direction of the antenna on account of the change of the sky or increases, for example, in a monotone with the increasing azimuth angle of the antenna and the optimum value of the azimuth angle can not be obtained, the held peak value is automatically reset. When a work to adjust the azimuth angle is interrupted merely for a while, the held peak value is not reset by mistake.

Figure 11:
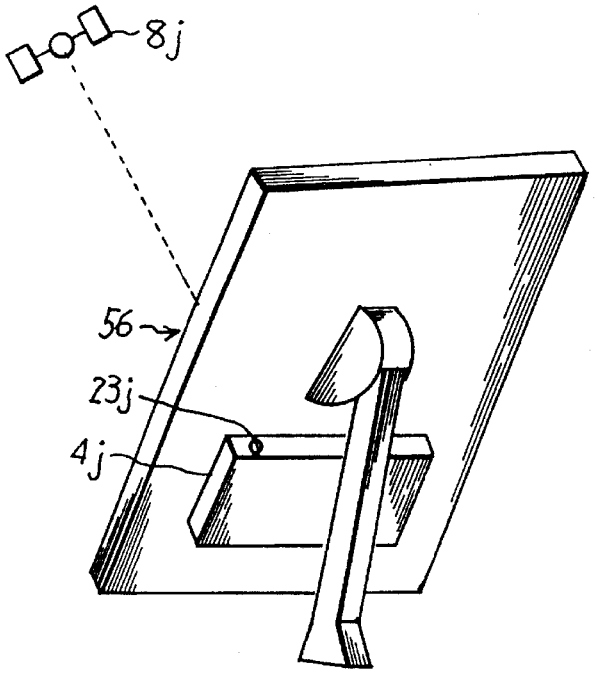
FIG. 11 is a perspective view showing a different example of the satellite radio wave receiving antenna.

The aforementioned satellite radio wave receiving antenna may be a plane antenna 56 in FIG. 11 or a center field type parabola antenna and a converter 4*j* provided with a display element 23*j* is provided on the rear surface of these antennas.

As many apparently different embodiments of this invention may be made without departing from the spirit and scope thereof, it is to be understood that the invention is not limited to the specific embodiments thereof except as defined in the appended claims.

What is claimed is:

1. A direction adjustment indicator for a satellite radio wave receiving antenna comprising a demodulating circuit adapted to demodulate a satellite radio wave received by said antenna, a peak holding circuit adapted to hold a peak value of the demodulated output of said demodulating circuit and always to output the held peak value, a reference value generator to generate a reference value, said reference value being made to agree with the output of said demodulating circuit which demodulates a satellite radio wave of a predetermined CN ratio, a signal selector adapted to recieve said held peak value and said reference value as two inputs thereof, said signal selector being further adapted to output the higher level signal out of the two inputs, a comparator circuit adapted to receive the output of the signal selector and said demodulated output as two inputs thereof, said comparator circuit being further adapted to give an output signal when said inputs are equal and to give another different output signal when said inputs are not equal, and a display element adapted to give two different kinds of display in accordance with said output signals.

* * * * *